US005498154A

United States Patent [19]

Velie et al.

[11] Patent Number: 5,498,154

[45] Date of Patent: Mar. 12, 1996

[54] BURNER WITH OVER SURFACE IGNITOR AND HIGH LIMIT CONTROL

[75] Inventors: Wallace W. Velie, Alta Loma; Donald C. Haney, Rancho Cucamonga, both of Calif.

[73] Assignee: Leland C. Scheu, Upland, Calif.

[21] Appl. No.: 231,514

[22] Filed: Apr. 22, 1994

[51] Int. Cl.[6] ..... F23Q 3/00

[52] U.S. Cl. ..... 431/264; 431/254; 431/255; 431/132; 431/263; 126/39 E

[58] Field of Search ..... 431/264, 254, 431/255, 263, 132, 43; 126/39 E

[56] References Cited

U.S. PATENT DOCUMENTS 4,081,238 3/1978 Briggs et al. ..... 432/222
4,315,298 2/1982 Mulkins et al. ..... 431/264 X
4,846,671 7/1989 Kwiatek ..... 431/264 X
4,861,264 8/1989 Romanak et al. ..... 431/264 X

*Primary Examiner*—Larry Jones
*Attorney, Agent, or Firm*—Jacobson, Price, Holman & Stern

[57] ABSTRACT

An ignition device for burners in which an ignition spark is established over a nonconducting surface between a hot electrode and a grounded electrode or electrically conductor portion which enables a greater spark distance to be obtained as compared to an ignition spark which jumps across an air gap between two conducting electrodes. An additional feature of the present invention is the provision of a high limit control positioned proximal the burner such that flame resulting from heater inlet blockage will flash upstream into the vicinity of the high limit control to control operation of the burner.

15 Claims, 2 Drawing Sheets

BURNER WITH OVER SURFACE IGNITOR AND HIGH LIMIT CONTROL

BACKGROUND OF THE INVENTION

1. Field of the Invention

The present invention generally relates to burner structures for use in portable heaters such as a high pressure oil burner provided with an oil discharge nozzle and air supply associated therewith to provide a combustible mixture which is ignited by a spark plug or a similar ignition device. More specifically, the invention relates to an ignition device for such burners in which an ignition spark is established over a nonconducting surface between a hot electrode and a grounded electrode or electrically conductor portion which enables a greater spark distance to be obtained as compared to an ignition spark which jumps across an air gap between two conducting electrodes. An additional feature of the present invention is the provision of a high limit control positioned proximal the burner such that flame resulting from heater inlet blockage will flash upstream into the vicinity of the high limit control to control operation of the burner.

2. Description of the Prior Art

Burners for use in a portable heater which utilize a spark plug type ignitor are well known with U.S. Pat. No. 4,081,238 issued Mar. 28, 1978 disclosing one such structure in which a conventional spark plug ignitor includes spaced electrodes defining an air gap through which a spark will jump to ignite a combustible mixture provided by an oil nozzle discharging a spray or mist of fuel oil associated with an air supply arrangement. Spark plugs and similar electrical spark ignition devices include spaced electrodes with one electrode being grounded and the other electrode connected to a high voltage energy source. When high voltage energy is supplied to the high voltage electrode, a spark characteristically jumps the air gap between the spaced tips of the two electrodes. The spark which jumps between the electrodes is located at a precise position in relation to a combustible mixture to obtain reliable ignition. In oil burners, the electrode spark is preferably located as far as possible from the oil spray with proper ignition relying upon "blowing" of the spark into the fringe of the oil spray. A spark can be "blown" a half inch or more by a moving air stream once the air between the electrodes has been ionized by the spark. More recent spark energy sources have been provided which replace a simple ignition transformer with an electronic system capable of providing increased high voltage energy sources and unique operating characteristics such as higher spark frequency thus providing the capability of improved ignition structures for oil burners and the like.

The above discussed prior art does not utilize an over surface spark device or ignition device for burners as disclosed in this application. Additionally, the prior art does not disclose a high limit control as disclosed in this application.

SUMMARY OF THE INVENTION

An object of the present invention is to provide an ignition device for an oil burner, such as used in a portable heater, in which an ignition spark between spaced electrodes moves over the surface of a nonconductive material.

Another object of the invention is to provide a burner ignition device utilizing an over surface spark movement to obtain a greater spark distance across a nonconducting surface as compared to movement of a spark through an air gap while utilizing the same spark voltage.

A further object of the invention is to provide an over surface spark electrode arrangement as defined in the preceding objects in an arrangement in which a center electrode terminates nearly flush with a nonelectrically conducting encapsulation supported by a grounded electrically conducting mounting bracket or in an arrangement in which the center electrode is recessed into a nonelectrically conductive encapsulation having an external grounded metal ring thereon. Both embodiments of the invention utilize a nonconductive encapsulation material which intersects the shortest path between spark termination points with the spark distance being substantially greater than the spark distance through an air gap in conventional spark plugs utilizing the same spark voltage.

Still another object of the invention is to provide a burner having a high limit control positioned in proximity to the burner whereby flame that may be caused by heater inlet blockage will flash upstream into the vicinity of the high limit control for controlling operation of the burner.

These together with other objects and advantages which will become subsequently apparent reside in the details of construction and operation as more fully hereinafter described and claimed, reference being had to the accompanying drawings forming a part hereof, wherein like numerals refer to like parts through out.

DESCRIPTION OF THE PREFERRED EMBODIMENTS

Figure 1:
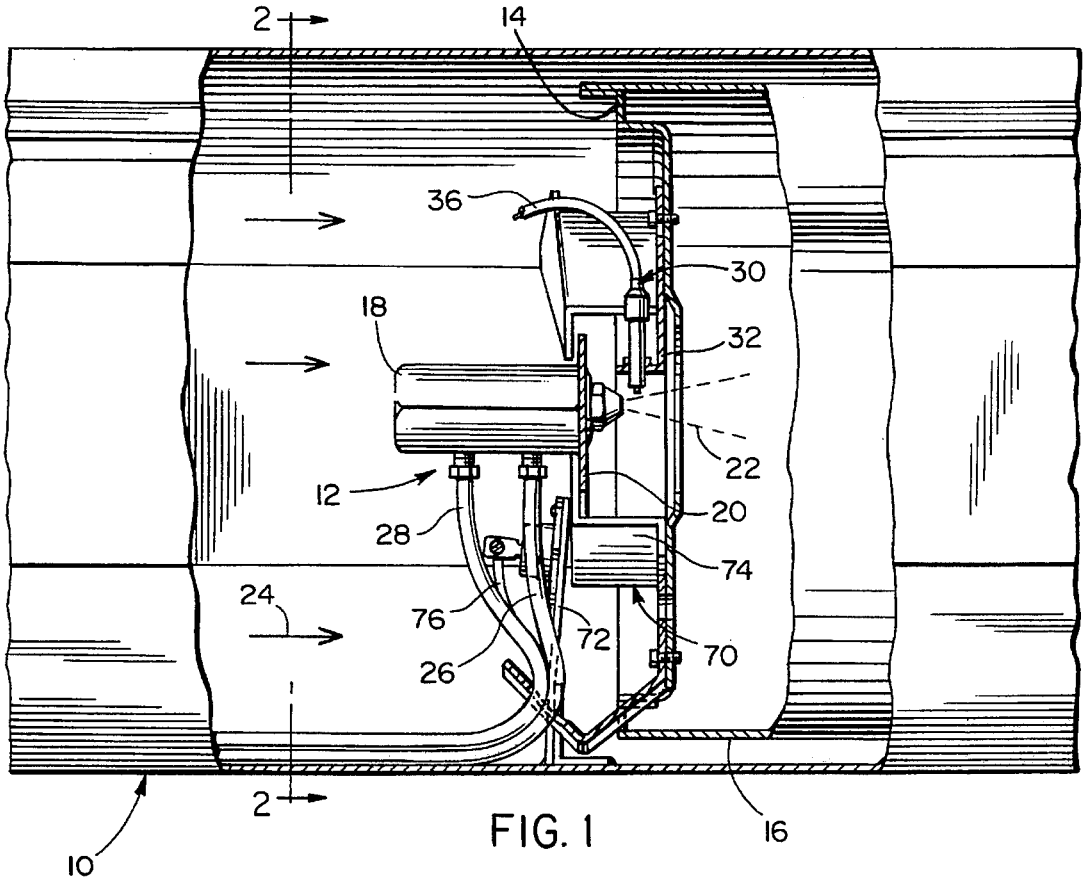
FIG. 1 is an elevational view, with portions shown in section illustrating a typical portable heater with the over surface ignition device and high limit control of the present invention incorporated therein.
Figure 2:
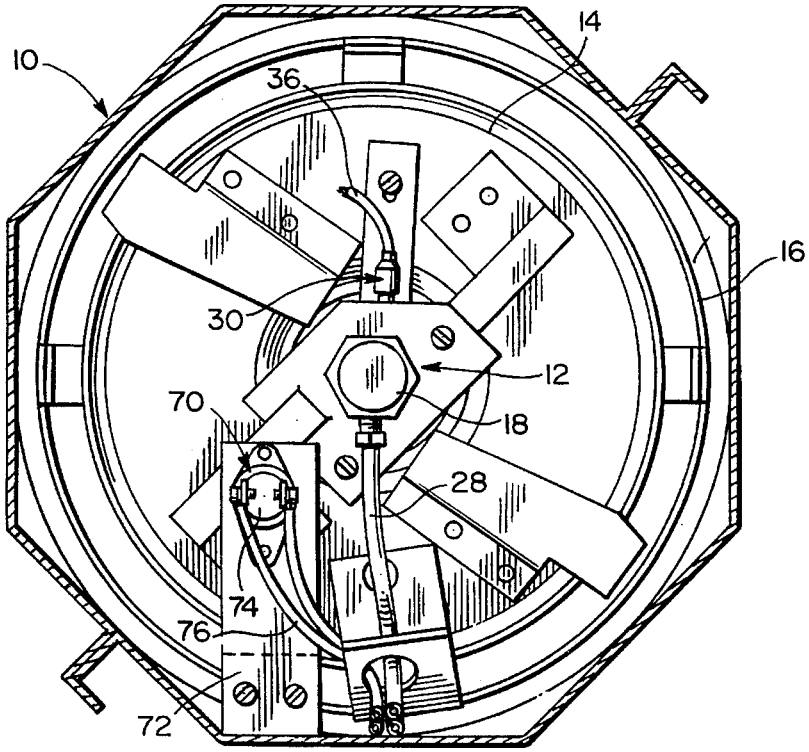
FIG. 2 is a transverse, sectional view taken along section line 2—2 on FIG. 1 illustrating further details of the burner with the over surface ignitor and high limit control associated therewith.

Referring to FIGS. 1 and 2 of the drawings, a tubular housing 10 of a portable heater is illustrated along with a burner assembly 12 supported by support structure 14 on one end of an inner shell 16. An oil nozzle 18 is supported by suitable bracket structure 20 for discharging a spray of combustible oil and air 22 for entrainment in air flow indicated by arrows 24 to provide a combustible mixture in the inner shell 16 in a well known and conventional manner such as illustrated in U.S. Pat. No. 4,081,238. The nozzle 18 may be the same as that disclosed in the above mentioned patent and includes an air hose 26 from an air compressor and a fuel hose 28 which coact to provide the combustible mixture.

The present invention involves an over surface ignition device generally designated by reference numeral 30 which is supported by a grounded bracket 32 to support the over surface ignition device 30 adjacent to but in spaced relation to the oil spray and air combustible mixture.

Figure 3:
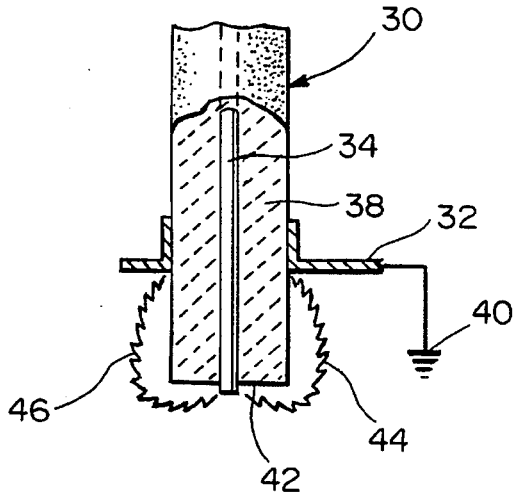
FIG. 3 is a fragmental, enlarged sectional view of one embodiment of the over surface spark device or ignitor in which the center electrode is substantially flush with an encapsulation of nonconductive material.

FIG. 3 illustrates one specific structure of the over surface ignition device 30 which includes a center electrode 34 connected to a high voltage source such as transformer or other high voltage generator through insulated conductor 36. Encapsulating the center hot electrode 34 is an encapsulation 38 of nonelectrically conducting material such as a ceramic material. The mounting bracket 32 surrounds and supports the encapsulation 38 and is grounded as indicated at reference numeral 40. Thus, the bracket 32 forms a grounded electrode spaced from the end of the encapsulation 38. As illustrated in FIG. 3, the center electrode is substantially flush with the end surface 42 of the nonelectrically conducting material although the terminal end of the electrode 34 is illustrated slightly beyond the surface 42.

When a high voltage source is connected to the center electrode, the spark 44 will follow a path over the external end surface 42 and the external peripheral surface 46 of the encapsulation 38 from the center electrode 34 to the grounded electrode 32 thereby establishing a longer or greater spark distance across the nonconducting surface for a spark voltage as compared to a spark distance through an air gap when utilizing the same voltage.

Figure 4:
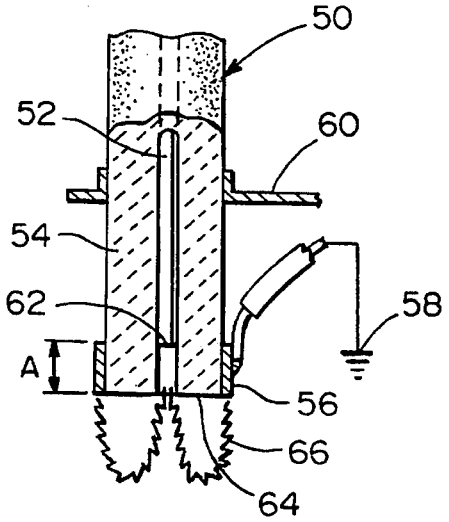
FIG. 4 is a sectional view illustrating another embodiment of the invention in which the center electrode is recessed with respect to the nonconductive encapsulation.

FIG. 4 illustrates another embodiment of the over surface ignition device generally designated by reference numeral 50 and includes a center electrode 52 connected to a high voltage source, an encapsulation 54 of nonelectrically conducting material and a metal conductive metal ring 56 mounted peripherally at the outer end of the encapsulation 54 with the metal ring 56 being grounded at 58. A supporting bracket 60 is provided for the spark device or ignition device 50 but is spaced remotely from the metal ring 56.

In this embodiment of the invention, the central electrode 52 terminates in an end 62 which is spaced inwardly from the end surface 64 of the encapsulation 54. Thus, the spark path 66 follows the surface from the inner end of the recess formed by the terminal end 62 of the center electrode across the outer end surface 64 to the metal grounded ring 56 thereby forming an over surface spark distance that is greater than the spark distance obtained by a spark passing through an air gap in a conventional spark plug when using the same voltage.

The nonelectrically conducting electrode encapsulation intersects the shortest distance between the hot center electrode and the grounded bracket 32 in FIG. 3 and the grounded metal ring 56 in FIG. 4. The interception of the nonelectrically conducted material also intersects the movement of a spark along the shortest distance from the terminal point of the hot electrode to the grounded electrode thereby assuring that the spark passes over the surface of the nonelectrically conductive material from the terminal point of the hot electrode to the terminal point of the grounded electrode. While the spark distance may vary, the over surface distance between the end points of spark emanation is greater than 5 millimeters.

Figure 5:
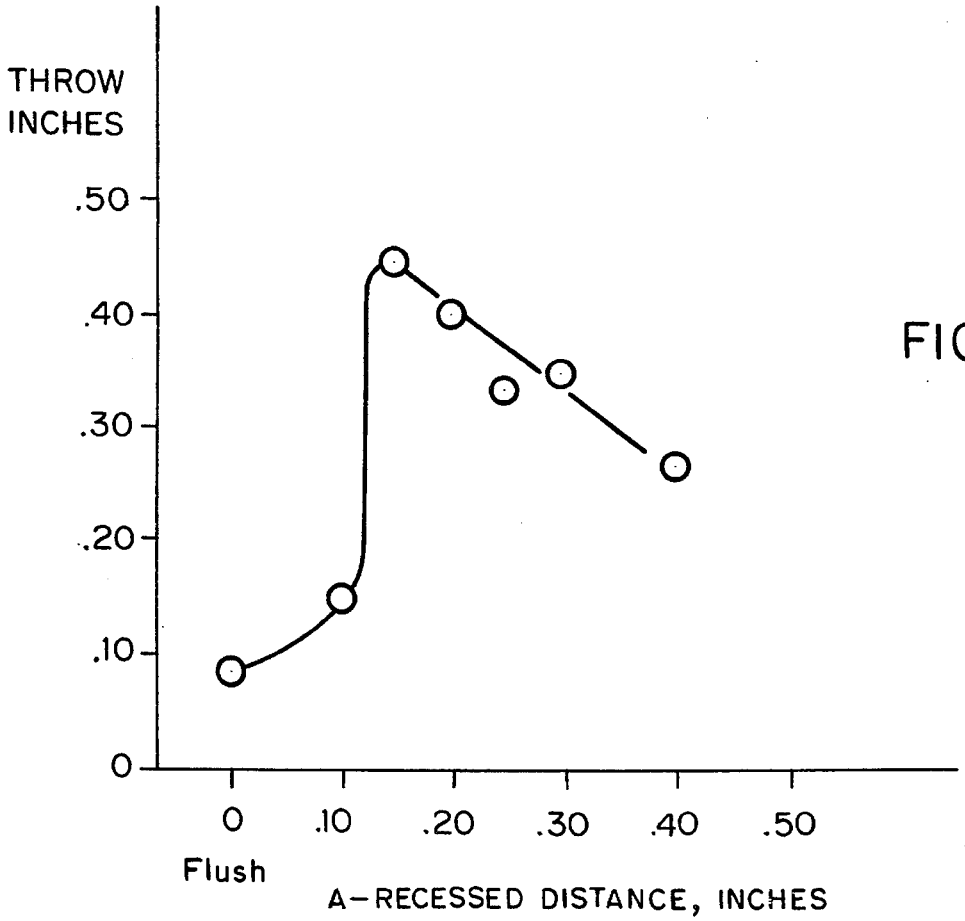
FIG. 5 is a schematic illustration of the relationship between the recessed position of the center electrode and grounded conductor portion to illustrate the over surface spark distance of the invention.

FIG. 5 illustrates schematically the throw distance or over surface distance between the end point of the center electrode and the terminal point of the grounded electrode with the base line indicating the flush or recessed relationship of the center electrode with the encapsulation as compared to the throw distance or spark distance obtained. The "A" distance being either the flush relationship of the center electrode or the recessed relationship of the center electrode as indicated in FIG. 4. The vertical reference line indicates throw inches or total spark distance for each "A" distance.

Conventional ignition devices employed in association with burners include conventional spark plugs used for various ignition devices which are constructed in order for a spark to jump across an air gap between two conducting electrodes. The air gap break down-voltage which is required to ionize the air and establish the spark between the electrodes is usually much higher than the voltage required to establish the same spark distance over the surface of a nonconducting materials. If two equally spaced electrodes emanate equally from a nonconductive material, such as ceramic material, the spark will jump to the ceramic surface rather than through an air gap to some other point which phenomenon is the basis for the tips of electrodes always being much closer together. Stated otherwise, a greater spark distance can be established across a nonconducting surface then through an air gap for the same spark voltage. Presently advanced high voltage spark generators are capable of supporting and establishing over surface sparks for considerable distances and actually many times that for traditional spark gaps. Also, higher frequency spark generators can generate a corona effect which is similar to "blowing" the spark. Accordingly, with this invention a more flexible and effective ignition device is provided by using the over the surface spark as compared to a spark plug or other electrode arrangement in which the spark passes through an air gap. This invention utilizes the nonconductive encapsulation material oriented so that it intersects the shortest path between spark termination points to establish over the surface spark distance which is substantially greater than conventional spark plugs.

FIGS. 1 and 2 also illustrate the high limit control 70 supported by a bracket 72 positioned upstream from the inner shell 16. The high limit control 70 includes a normally closed heat sensitive switch 74 provided with electrical conductors 76. The switch 74 is placed in the proximity to the burner so that any flames which flash upstream due to heater inlet blockage or any other circumstances will engage or be in the vicinity of the switch 74 which opens when sensing excessive heat to actuate a circuit to close a fuel valve if the system includes such a valve to eliminate or reduce the flow of fuel to the oil nozzle 18 thereby providing a safety control for the burner. If the system does not have a fuel valve, the switch 74 can interrupt a circuit to other major components such as the motor for the air compressor with the entire burner being shut down when a flame sensor determines that no flame is being produced by the burner.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A burner producing a combustible mixture and a spark device for igniting the combustible mixture, said spark device comprising an electrically conducting electrode connected to a high voltage source of electrical energy and a grounded electrically conductor portion positioned in spaced relation to the conducting electrode and a nonelectrically conducting electrode encapsulation positioned to intercept the shortest distance between the electrode and the grounded portion whereby spark emanating from the electrode is intercepted by the nonelectrically conductive encapsulation requiring the spark to pass over the surface of said encapsulation.

2. The burner as defined in claim 1 wherein said electrode is centrally located in said encapsulation and said grounded electrically conductor portion is oriented externally of said encapsulation.

3. The burner as defined in claim 2 wherein said electrode terminates substantially flush with an end of said encapsulation, said electrically conductor portion is a grounded bracket supportingly engaging the encapsulation and located in spaced relation to the end of said encapsulation whereby the encapsulation intercepts the shortest distance between the electrode and the grounded bracket, said spark passing over the end surface of the encapsulation and the peripheral surface of the encapsulation to the grounded bracket.

4. The burner as defined in claim 2 wherein said electrode terminates in an end spaced inwardly from an end of said encapsulation with a passageway extending from a terminal end of said electrode to an end of the encapsulation, said grounded electrically conductor portion being a grounded electrically conductor ring on a periphery of said encapsulation at the end of the encapsulation thereby intercepting the shortest distance between the end of the electrode and the grounded ring whereby spark passes over the surface of the encapsulation from the electrode to the grounded ring.

5. A burner producing a combustible mixture and a spark device for igniting the combustible fixture, said spark device comprising an electrically conducting electrode connected to a high voltage source of electrical energy and a grounded electrically conductor portion positioned in spaced relation to the conducting electrode and a nonelectrically conducting electrode encapsulation positioned to intercept the shortest distance between the electrode and the grounded portion whereby spark emanating from the electrode is intercepted by the nonelectrically conductive encapsulation requiring the spark to pass over the surface of said encapsulation, and a high limit control located in proximity to the burner to interrupt operation of the burner in response to flame flashing upstream from the burner and combustible mixture.

6. The burner as defined in claim 5 wherein said electrode is centrally located in said encapsulation and said grounded electrically conductor portion is oriented externally of said encapsulation.

7. The burner as defined in claim 6 wherein said electrode terminates substantially flush with an end of said encapsulation, said electrically conductor portion being a grounded bracket supportingly engaging the encapsulation and located in spaced relation to the end of said encapsulation whereby the encapsulation intercepts the shortest distance between the electrode and the grounded bracket with the spark passing over the surface of the encapsulation.

8. The burner as defined in claim 6 wherein said electrode terminates in an end spaced inwardly from an end of said encapsulation with a passageway extending from a terminal end of said electrode to an end of the encapsulation, said grounded electrically conductor portion being a grounded electrically conductor ring on a periphery of said encapsulation at the end of the encapsulation thereby intercepting the shortest distance between the end of the electrode and the grounded ring whereby spark passes over the surface of the encapsulation from the electrode to the grounded ring.

9. An electrical sparking device comprising a center electrically conducting electrode adapted to be connected to a high voltage energy source, a nonelectrically conducting electrode encapsulation and a grounded electrically conductor portion positioned in relation to the electrode and encapsulation whereby the shortest distance between the grounded portion and the point of spark emanation from the center electrode is intercepted by the nonelectrically conductive encapsulation with the spark emanating from the electrode following an ionized path on the surface of the encapsulation to the grounded portion.

10. The sparking device as defined in claim 9 wherein said center electrode terminates adjacent an end of the encapsulation, said grounded electrically conductor portion being spaced from the center electrode.

11. The sparking device as defined in claim 10 wherein said conductor portion is a grounded bracket spaced from an end of the encapsulation.

12. The sparking device as defined in claim 11 wherein said electrode terminates in an end substantially flush with an end of said encapsulation with the spark emanating from the electrode passing along an ionized path across the end surface of the encapsulation and longitudinally along the peripheral surface of the encapsulation to said grounded bracket.

13. An electrical sparking device comprising a center electrically conducting electrode adapted to be connected to a high voltage energy source, a nonelectrically conducting electrode encapsulation and a grounded electrically conductor portion positioned in relation to the electrode add encapsulation whereby the shortest distance between the grounded portion and the point of spark emanation from the center electrode is intercepted by the nonelectrically conductive encapsulation, said center electrode terminates adjacent an end of the encapsulation, said grounded electrically conductor portion being spaced from the center electrode, said conductor portion being a grounded conductor ring mounted peripherally at one end of said encapsulation.

14. The sparking device as defined in claim 13 wherein the over surface distance along the encapsulation between the terminal end point of spark emanation from the electrode to the grounded electrically conductor portion is greater than 5 millimeters.

15. The sparking device as defined in claim 13 wherein said electrode terminates in an end spaced inwardly from the end of the encapsulation having the conductor ring mounted thereon, said encapsulation including a passageway extending from the terminal end of the electrode to the end of the encapsulation having the conductor ring mounted thereon.

* * * * *